US005341532A

United States Patent [19]

Markowitz

[11] Patent Number: 5,341,532

[45] Date of Patent: Aug. 30, 1994

[54] INFLATABLE STUFFING FOR FOOTWEAR

[76] Inventor: Edward Markowitz, 277 Prospect Ave., Hackensack, N.J. 07602

[21] Appl. No.: 68,280

[22] Filed: May 27, 1993

Related U.S. Application Data

[63] Continuation of Ser. No. 859,571, Mar. 27, 1992, abandoned.

[51] Int. Cl.[5] ..... A43D 3/00

[52] U.S. Cl. ..... 12/114.4; 12/128 R

[58] Field of Search ..... 12/114.4, 128 R

[56] References Cited

U.S. PATENT DOCUMENTS

| | | | |
|---|---|---|---|
| 258,917 | 6/1882 | Hawley | 12/114.4 |
| 587,341 | 8/1897 | Stevens | 12/114.4 |
| 619,108 | 2/1899 | White | 12/114.4 |
| 622,137 | 3/1899 | Fitzjarrell . | |
| 673,063 | 4/1901 | Ruggles et al. . | |
| 795,217 | 7/1905 | Gaunt . | |
| 1,012,978 | 12/1911 | Bowron . | |
| 1,048,826 | 12/1912 | Grune . | |
| 2,306,036 | 12/1942 | Campbell | 12/129 |
| 3,483,580 | 12/1969 | Cherry et al. | 12/114.4 |
| 3,729,759 | 5/1973 | Szabo | 12/114.4 |
| 4,400,840 | 8/1983 | Sly | 12/114.4 |

FOREIGN PATENT DOCUMENTS

| | | | |
|---|---|---|---|
| 0092833 | 9/1896 | Fed. Rep. of Germany | 12/114.4 |
| 2386277 | 12/1978 | France | 12/114.4 |
| 2555038 | 5/1985 | France | 12/114.4 |

*Primary Examiner*—Paul T. Sewell
*Assistant Examiner*—Ted Kavanaugh
*Attorney, Agent, or Firm*—Kirschstein, Ottinger, Israel & Schiffmiller

[57] ABSTRACT

A foot-shaped inflatable stuffing is inserted into and removed from footwear. The stuffing has a tapered insert and a gas inlet. The inlet allows gas to be admitted into the insert, and also serves as a convenient handle to effect removal of the stuffing.

3 Claims, 4 Drawing Sheets

3
3
10
14
16
18
20
22
24
26
28
30
32
34
36
38
40
42
52
54

INFLATABLE STUFFING FOR FOOTWEAR

This application is a continuation of 07/859,571 filed on Mar. 27, 1992, now abandoned.

BACKGROUND OF THE INVENTION

1. Field of the Invention

This invention generally relates to stuffed footwear and, more particularly, to an inflatable stuffing for insertion into, and removal from, footwear, as well as to a method of removably stuffing footwear.

2. Description of Related Art

When not worn, shoes are often stuffed with shoe forms to maintain their shape and resist wrinkling of the material constituting the upper shoe part. Shoe forms utilizing tension springs, or outwardly-acting biasing clamps, or bags filled with particulate filler are well known and are used by consumers, typically in a home and especially to maintain the shapes of expensive shoes or boots fabricated of leather and like light, thin materials.

Although the known shoe forms are satisfactory for their intended purpose, they are not generally employed to stuff shoes prior to their purchase primarily due to the prohibitive cost of the shoe forms. Shoe manufacturers that produce shoes in mass production typically stuff their shoes with multiple wads of crushed paper, which serves to maintain the shoe shapes during transport to retailers, and sometimes even during display at the retailers.

The stuffing of shoes with paper, however, has not proven to be altogether desirable. Foremost of all concerns is the cost of labor involved not only in initially stuffing each shoe, but also in removing the multiple wads of paper therefrom. At the manufacturing end, a multitude of crushed paper wads represents a non-negligible fire hazard. At the retailing end, the removed crushed paper wads are unsightly and must be discarded, thereby raising waste disposal concerns.

It is known to ship handbags, duffle bags, luggage and like soft-walled non-self-supporting bags with inflated inserts of generally parallelepiped configuration. Such bags have wide, usually zippered, openings commensurate in length with the length of the inflated inserts so that the inserts can be readily bodily inserted into the wide openings of such bags. In shoes, however, and especially in boots, the foot opening is much smaller than the length of the shoe and, hence, box-like inserts cannot be used to stuff shoes because the inserts would not reach the front toe part of the shoe.

SUMMARY OF THE INVENTION

1. Objects of the Invention

It is a general object of this invention to provide a dependable, inexpensive, inflatable stuffing for insertion into and removal from footwear.

It is another object of this invention to eliminate the requirement for stuffing shoes with crushed paper.

Another object of this invention is to reduce the cost of stuffing shoes and of removing the stuffing from shoes.

A further object of this invention is to remove footwear stuffing in one motion without having to repetitively remove individual pieces of stuffing.

2. Features of the Invention

In keeping with these objects, and others which will become apparent hereinafter, one feature of this invention resides, briefly stated, in a stuffing for insertion into and removal from footwear such as shoes, boots and the like. The stuffing includes a tapered, inflatable insert having a front toe region, a rear heel region, and a plurality of boundary walls bounding an interior and extending from the toe to the heel regions. A gas inlet integral with the insert enables gas admission to the interior to inflate the insert. The inlet itself extends outwardly of the insert for enabling the manual removal of the insert from the footwear.

In accordance with one aspect of this invention, one of the boundary walls diverges away from another of the boundary walls as considered along the longitudinal direction from the toe to the heel regions. The diverging boundary walls may constitute the side walls of the insert and/or the top and bottom walls of the insert. In a preferred embodiment, the insert has a generally conical configuration with a generally circular cross-section. This feature permits easy insertion of the insert into the footwear so that all interior surfaces thereof are reliably supported, as well as easy removal.

In accordance with another aspect of this invention, the gas inlet is foldable from an access position in which the inlet extends outwardly of the insert, to a tucked-in position in which the inlet overlies the insert within the footwear. In the access position, gas is readily introduced into the insert. Also, the outwardly-extending inlet serves as a convenient handle by which the insert is removed from the footwear. In the tucked-in position, the inlet is reliably folded out of the way to prevent accidental removal of the insert. Preferably, the inlet is folded underneath a tongue part of the footwear.

This invention also comprises a method of removably stuffing footwear which comprises the steps of forming the inflatable insert with a gas inlet, and inflating the insert by admitting gas through the inlet to the interior of the insert. The insert is preferably inflated prior to insertion into the footwear. During insertion, a front toe region of the insert engages a toe part of the footwear, and a rear heel region of the insert engages a heel part of the footwear, thereby creating a snug fit.

Removal of the inflated insert is advantageously performed in a single motion or stroke merely by pulling on the inlet. This feature, of course, obviates the prior art necessity of repetitively removing multiple stuffing materials.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 8:
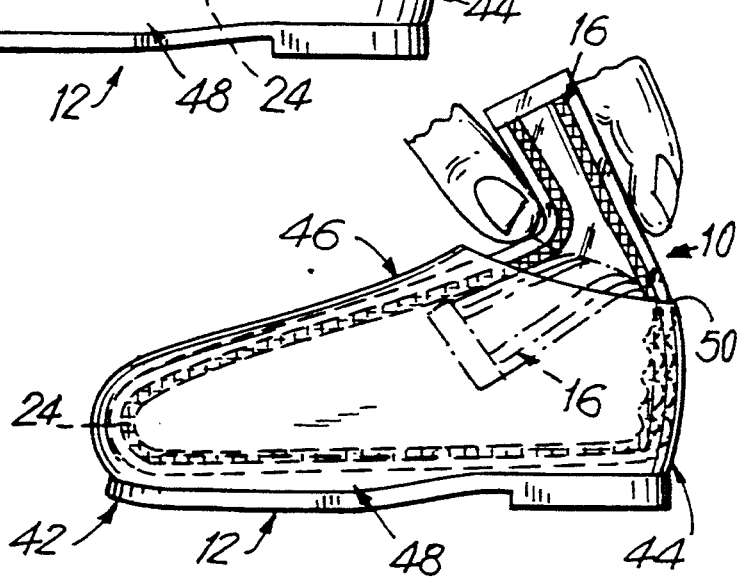
FIG. 8 is a view analogous to FIG. 7, but at a later stage of insertion.
Figure 9:
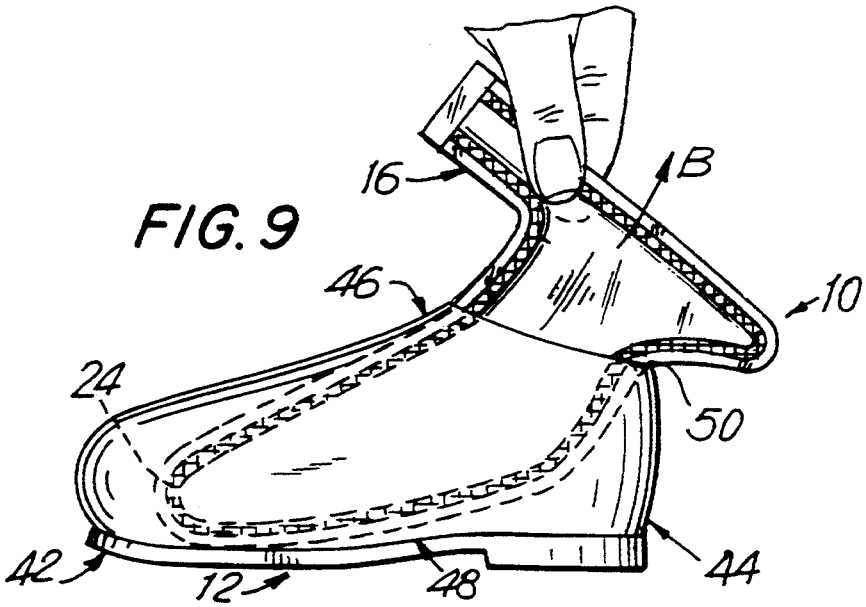
FIG. 9 is a view analogous to FIG. 8 during an initial stage of removal of the stuffing from the shoe.

Referring now to the drawings, reference numeral 10 generally identifies a foot-shaped stuffing for insertion into a shoe 12 (see FIGS. 7 and 8) and for removal from the shoe 12 (see FIG. 9). Stuffing 10 includes a tapered inflatable insert 14 and a gas inlet 16 integral therewith. As explained below, gas such as air is introduced under pressure into the inlet 16 to inflate the insert 14. The insert is preferably inflated prior to insertion into the shoe, but could equally well be inflated in situ within the shoe.

Figure 4:
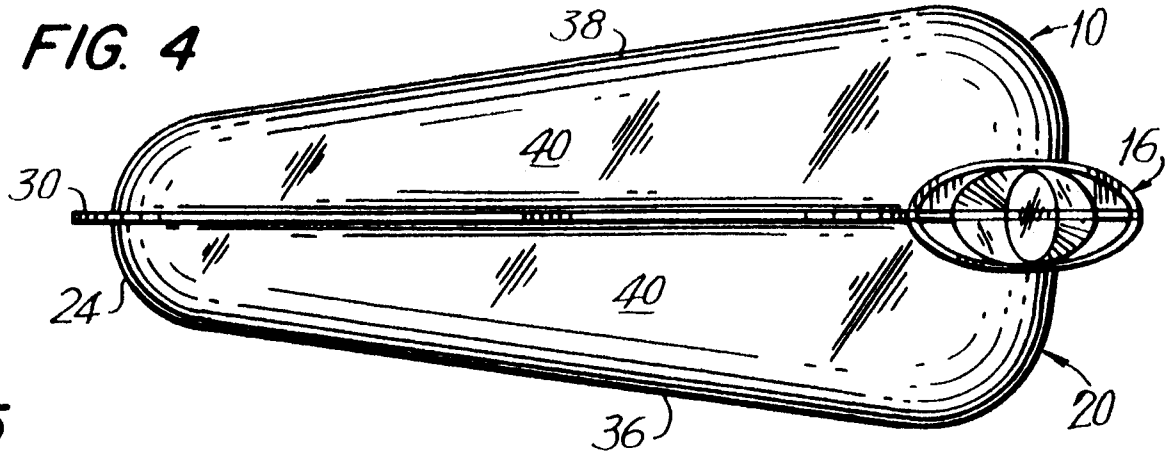
FIG. 4 is a top plan view of the stuffing of FIG. 1.
Figure 6:
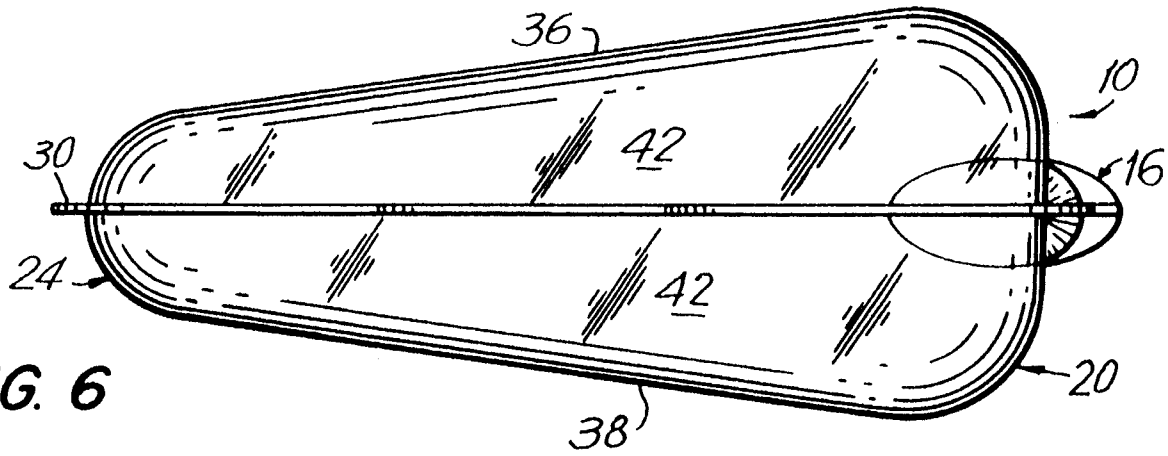
FIG. 6 is a bottom plan view of the stuffing of FIG. 1.

Stuffing 10 is constituted of a pair of overlying generally L-shaped planar sheets of synthetic plastic material that are sealed together along a peripheral heat-fused seal 18. As best seen in FIG. 4, seal 18 extends horizontally from a rear heel region 20 of the insert along a sole region 22 to a front toe region 24 from which the seal 18 rises in elevation to a front ankle region 26. Seal 18 extends vertically from the heel region 20 to a rear ankle region 28 spaced apart from the front ankle region 26. Seal 18 diverges along the front and rear regions of the inlet away from ankle regions 26, 28. Seal 18 is formed by application of heat and/or pressure so that the sheets are gas-tight. Seal 18 is inwardly spaced a short distance, e.g. ¼", from outer peripheral edges of the sheets, thereby creating a peripheral selvage 30.

Figures 1, 2, 3:
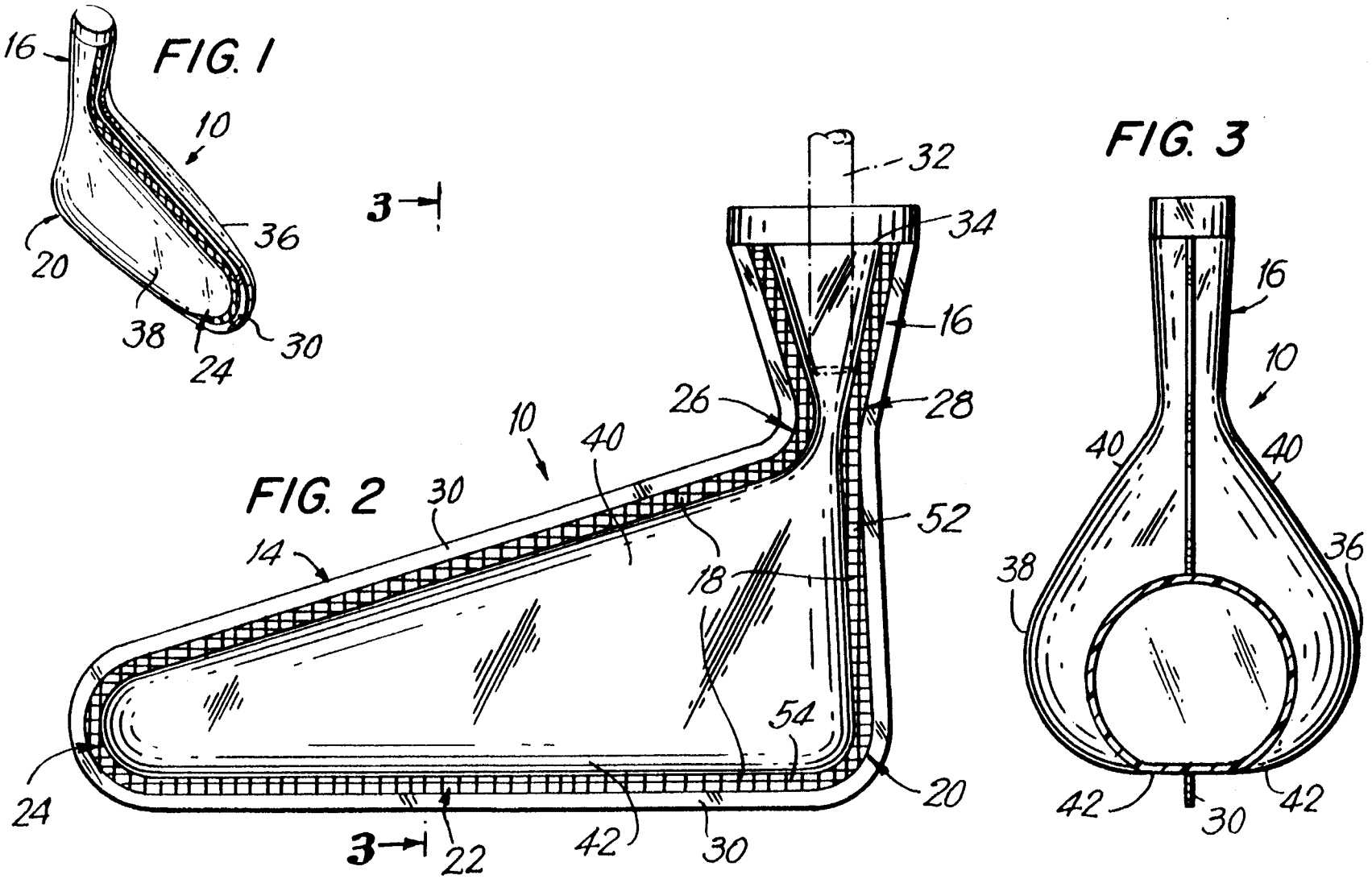
FIG. 1 is a front perspective view on a reduced scale of one embodiment of an inflated stuffing according to this invention.
FIG. 2 is a side elevational view of the stuffing of FIG. 1.
FIG. 3 is a sectional view taken on line 3—3 of FIG. 2.

A filling inlet 32, shown in phantom lines in FIG. 2, is inserted into inlet 16 to admit pressurized gas, e.g. air, from a non-illustrated air pump source. Once fully inflated, nozzle 32 is removed, and the inlet 16 is sealed by either heat-fusing an open end 34 of the inlet 16, and/or automatically by incorporating a normally-closed check valve within the open end. The check valve is constituted by a foldable flap integral with one of the sheets and folded over to lie between the sheets. The nozzle 32 is inserted between the flap and the other sheet for inflation purposes. Upon removal of the nozzle, the interior air pressure within the insert forces the flap against the other sheet, thereby sealing the stuffing.

Figure 5:
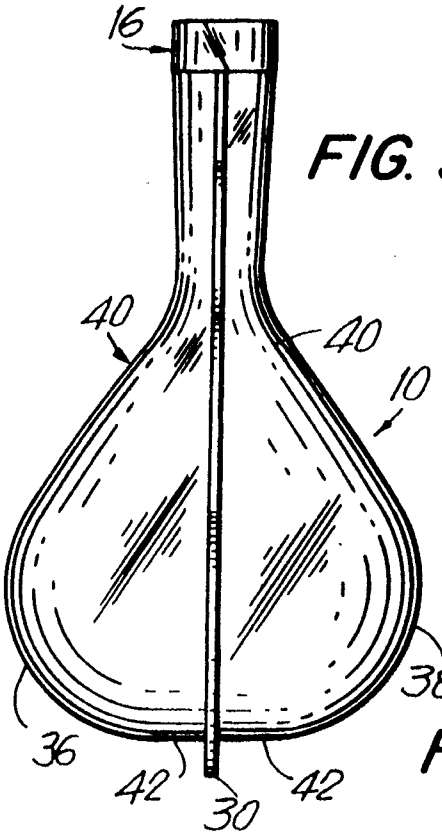
FIG. 5 is a rear elevational view of the stuffing of FIG. 1.

Once inflated, the outwardly-bulging insert has side walls 36, 38, a top wall 40 subdivided by selvage 30, and a bottom wall subdivided by selvage 30. The front toe region 24 and the rear heel region 20 preferably have rounded contours. As best seen in FIGS. 4 and 5, the side walls 36, 38 diverge apart as considered longitudinally from the toe region 24 to the heel region 20. As best seen in FIG. 2, the top wall 40 and the bottom wall 42 diverge apart as considered longitudinally from the toe region 24 to the heel region 20. The insert has a generally conical configuration having a generally circular cross-section (see FIG. 3). Once inflated, the inlet 16 has a funnel shape.

Figure 7:
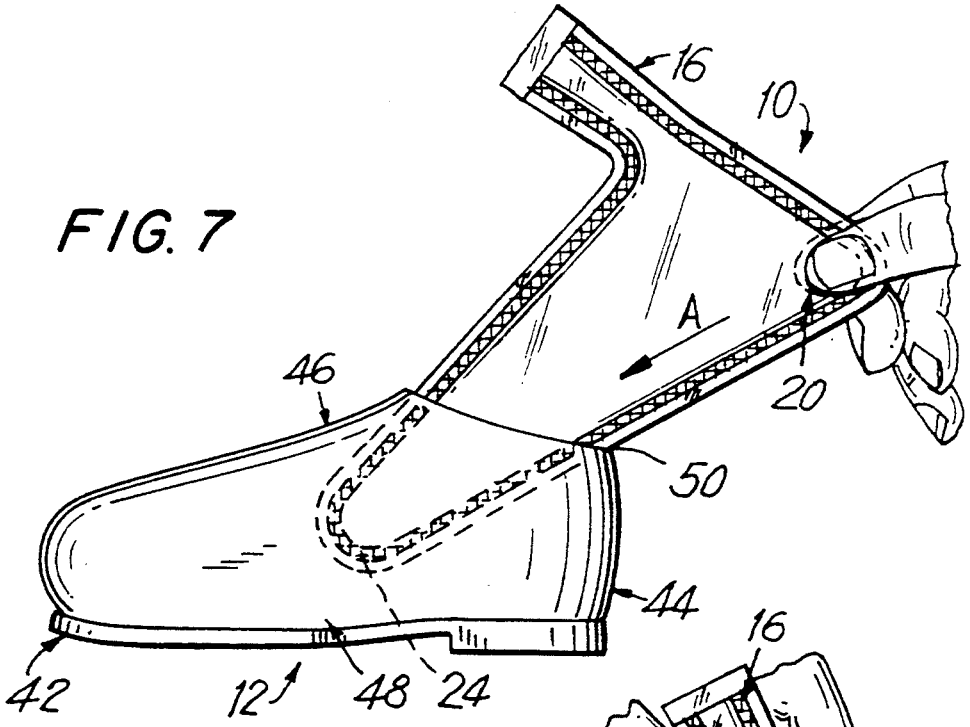
FIG. 7 is a side elevational view of the stuffing of FIG. 1 during an initial stage of insertion into a shoe.

As shown in FIGS. 7 and 8, to stuff the shoe 12 having a toe part 42, a heel part 44, a tongue part 46, a sole part 48, and a foot opening 50 at one end of the shoe, one need only insert the toe region 24 into the foot opening 50 and push the inflated insert into the shoe until the toe region 24 is pressed into engagement with the toe part 42. During this pushing motion, the user graps the heel region 20 and pushes in the direction of arrow A.

Thereupon, one pushes the heel region 20 downwardly into the shoe until the heel region 20 snugly engages the interior of the heel part 44. The inflated insert is inherently resilient, and will automatically conform to the interior dimensions of the shoe being stuffed. The inflated insert supports the material of the shoe upper to resist wrinkling and creasing.

Inlet 16 is foldable about the ankle regions 26, 28 from an access position, e.g. FIG. 2 in which the inlet extends outwardly of the insert, to a tucked-in position 16', shown in phantom lines in FIG. 8, wherein the folded-over inlet overlies the insert within the shoe and lies underneath the tongue part 46. Of course, the folded inlet can equally well be folded to lie between the insert and a side wall of the shoe or a heel counter of the shoe. Once tucked-in, the inlet cannot be accidentally engaged to effect removal of the insert.

To remove the insert, one need only unfold the tucked-in inlet and grasp the same, as shown in FIG. 9. Thereupon, the user pulls the insert from the shoe with a single motion in the direction of arrow B.

Figure 10:
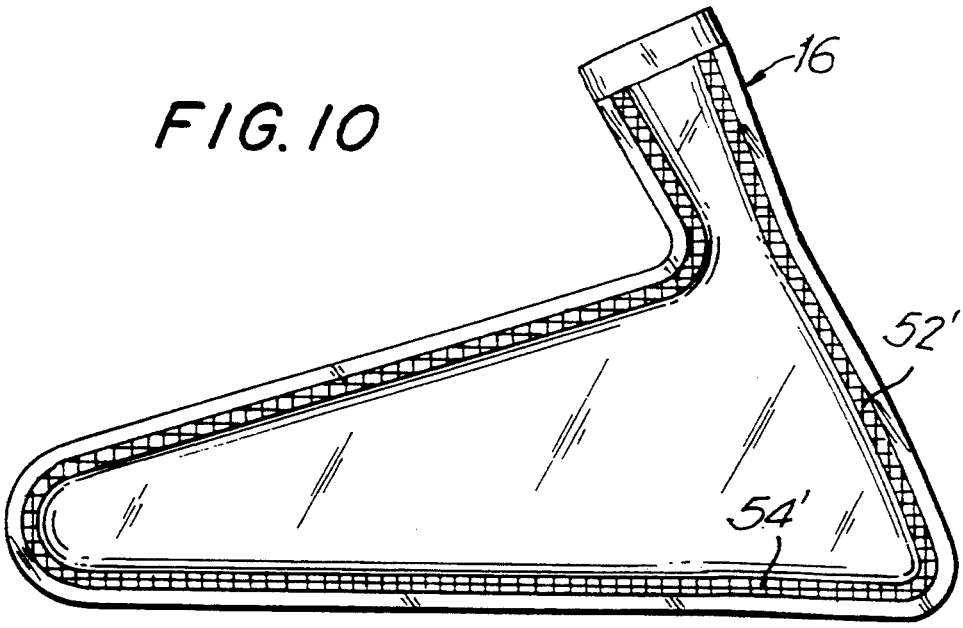
FIG. 10 is a view analogous to FIG. 2, but of another embodiment of this invention.
Figure 11:
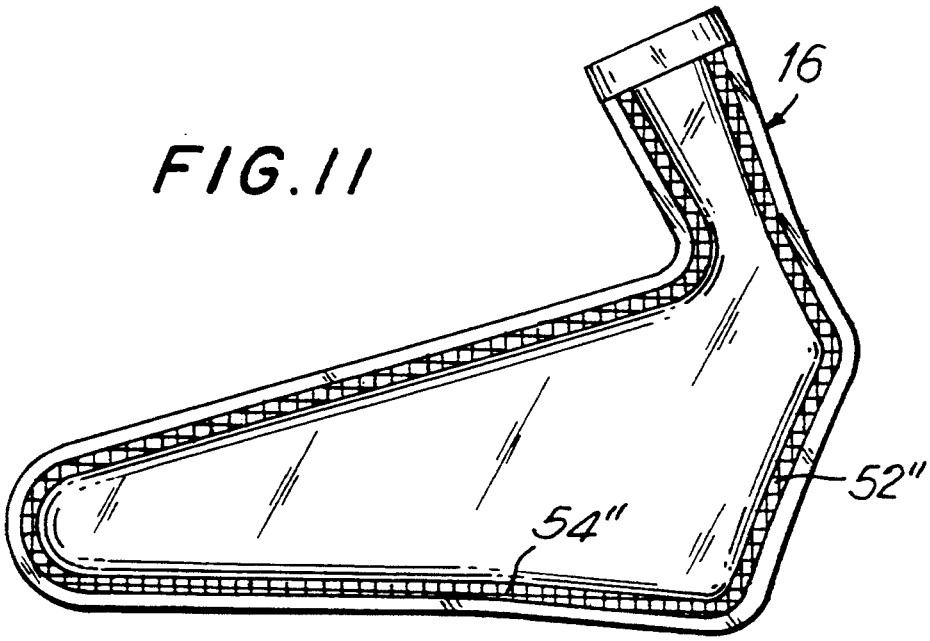
FIG. 11 is a view analogous to FIG. 2, but of still another embodiment of this invention.

As depicted in FIGS. 10 and 11, the insert may be modified such that the inlet 16, rather than facing straight up as depicted in FIG. 2, is inclined forwardly. Thus, a rear vertical heel seam 52, in FIG. 2, extends at approximately a right angle to a horizontal sole seam 54. In FIG. 10, the heel seam 52' includes an acute angle with the corresponding sole seam 54'. In FIG. 11, the rear heel seam 52" extends at an obtuse angle with the corresponding sole seam 54".

Each insert can accommodate shoe sizes within a limited range. Of course, different foot-shaped stuffings would be required for shoe sizes outside of said range.

Once removed, or even prior to removal, the stuffing may be pierced to deflate the insert, thereby simplifying the removal procedure and waste disposal concerns.

It will be understood that each of the elements described above, or two or more together, also may find a useful application in other types of constructions differing from the types described above.

While the invention has been illustrated and described as embodied in an inflatable stuffing for footwear, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A gas-inflatable stuffing for insertion into, and removal from, footwear, comprising:

a pair of overlying, generally L-shaped, planar sheets of synthetic plastic material having outer peripheral edges; said sheets being heat-sealed together along a heat-fused seal spaced inwardly of the outer peripheral edges; said sealed sheets having a rear heel region, a front toe region, a sole region extending in a longitudinal direction between the rear heel region and the front toe region, front and rear ankle regions spaced apart along the longitudinal direction above the rear heel region, and front and rear gas inlet regions extending in a transverse direction upwardly from the front and rear ankle regions, respectively; said seal extending in the longitudinal direction from the rear heel region along the sole region to the front toe region; said seal also extending in the longitudinal direction from the front toe region to the front ankle region and continuing in the transverse direction along the front gas inlet region, said seal further extending in the transverse direction from the rear heel region to the rear ankle region and continuing in the transverse direction along the rear gas inlet region; said front and rear gas inlet regions being spaced apart along the longitudinal direction to bound a gas inlet having an upper open end through which gas is introduced between the sheets to inflate the stuffing; and a heat-fused closure seal extending along the longitudinal direction across and closing said upper open end to seal the inflated stuffing.

2. The stuffing according to claim 1, wherein the sealed sheets have a selvage extending from the front gas inlet region to the front ankle region and the front toe region, and along the sole region, to the rear heel region, the rear ankle region, and the rear gas inlet region in succession.

3. The stuffing according to claim 1, wherein the front and rear gas inlet regions diverge away from each other as considered along the transverse direction away from the front and rear ankle regions and away from the rear heel region.

* * * * *